United States Patent [19]

Kelly

[11] Patent Number: 4,567,631

[45] Date of Patent: Feb. 4, 1986

[54] METHOD FOR INSTALLING TUBES IN TUBE SHEETS

[75] Inventor: John W. Kelly, Burbank, Calif.

[73] Assignee: Haskel, Inc., Burbank, Calif.

[21] Appl. No.: 541,564

[22] Filed: Oct. 13, 1983

Related U.S. Application Data

[60] Division of Ser. No. 271,372, Jun. 8, 1981, abandoned, which is a continuation-in-part of Ser. No. 255,789, Apr. 20, 1981, Pat. No. 4,387,507.

[51] Int. Cl.[4] ..... B23P 15/26; B23P 11/02; B21D 39/20

[52] U.S. Cl. ..... 29/157.3 C; 29/157.4; 29/237; 29/421 R; 29/523; 29/727; 72/58; 72/62

[58] Field of Search ..... 29/157.3 C, 157.4, 237, 29/421 R, 523, 727; 72/57, 58, 59, 60, 61, 62

[56] References Cited

U.S. PATENT DOCUMENTS

| | | | |
|---|---|---|---|
| 616,764 | 12/1898 | Bourke | 72/59 |
| 3,432,916 | 3/1969 | Fisher et al. | 29/516 |
| 3,977,068 | 8/1976 | Krips | 29/421 R |
| 4,068,372 | 1/1978 | Kamohara et al. | 72/58 X |
| 4,069,573 | 1/1978 | Rogers, Jr. et al. | 29/157.3 C |
| 4,320,586 | 3/1982 | Herrod et al. | 29/421 R |
| 4,359,889 | 11/1982 | Kelly | 72/62 |
| 4,368,571 | 1/1983 | Cooper, Jr. | 29/421 R |
| 4,387,507 | 6/1983 | Kelly | 29/727 |
| 4,445,261 | 5/1984 | Kelly | 29/157.4 |

FOREIGN PATENT DOCUMENTS

| | | | |
|---|---|---|---|
| 2026420 | 1/1978 | Fed. Rep. of Germany | 72/58 |
| 15571 | 2/1977 | Japan | 72/59 |
| 28768 | 3/1979 | Japan | 72/58 |

*Primary Examiner*—Howard N. Goldberg
*Assistant Examiner*—Ronald S. Wallace
*Attorney, Agent, or Firm*—Pretty, Schroeder, Brueggemann & Clark

[57] ABSTRACT

A method for radially expanding tubes within a tube sheet involves the application of radially expansive swaging forces from a pre-expander apparatus and a hydraulic mandrel. The pre-expander is used first and includes at least one primary expander and at least one secondary expander. The expanders surround and are compressed axially by a draw bar, thereby producing outwardly directed radial pressure against the interior surface of the tube anchoring the tube within the tube sheet. An unexpanded land remains between the two expanded regions corresponding to an axially incompressible spacer that separates the expanders. Next, the hydraulic mandrel, which has seals that define the ends of a pressure zone, is inserted in the tube and positioned so that both seals engage unexpanded portions of the tube, one of these unexpanded portions being the land. Upon the application of hydraulic pressure, the axial forces acting on the mandrel are balanced, and the tube is expanded to form a joint having the desired leak-proof qualities.

11 Claims, 7 Drawing Figures

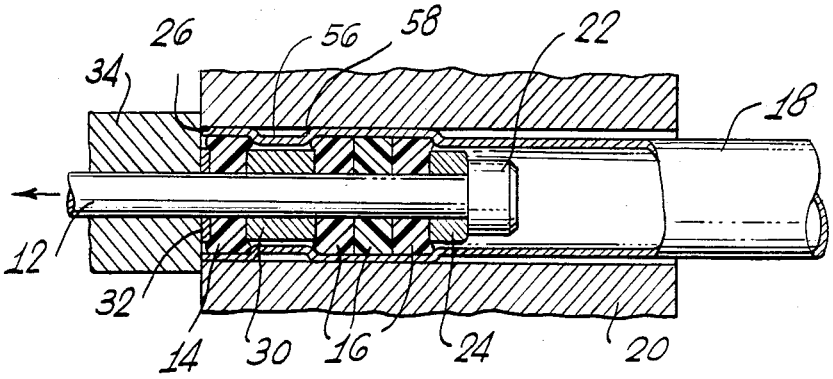
Fig. 3
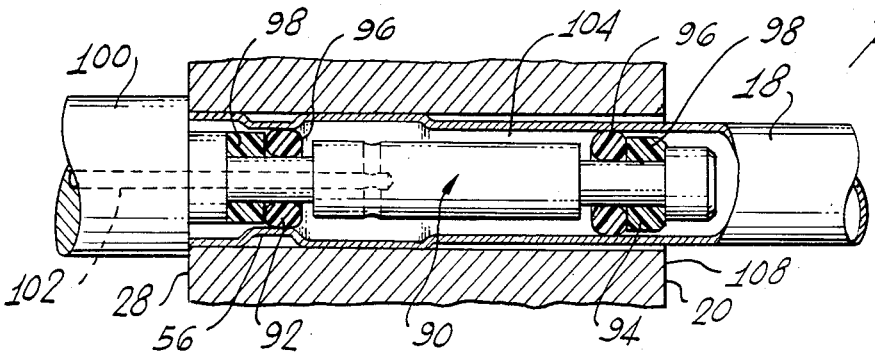
Fig. 4
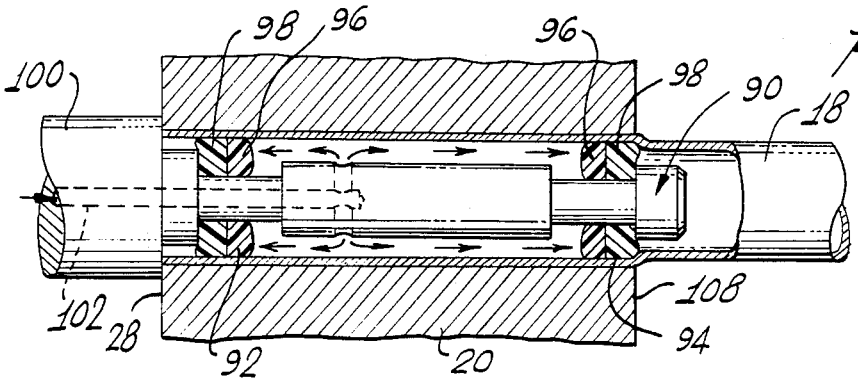
Fig. 5
Fig. 6
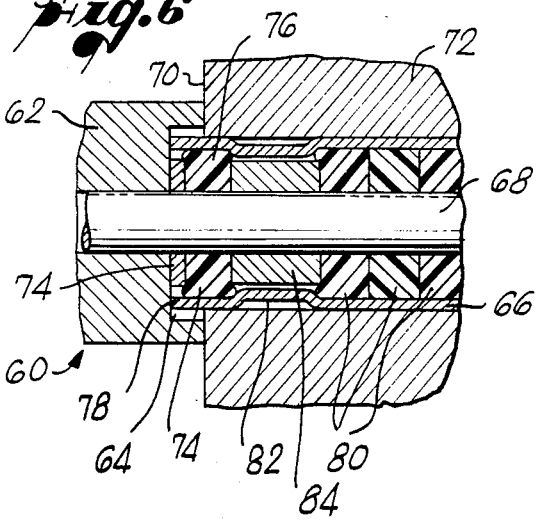
Fig. 7
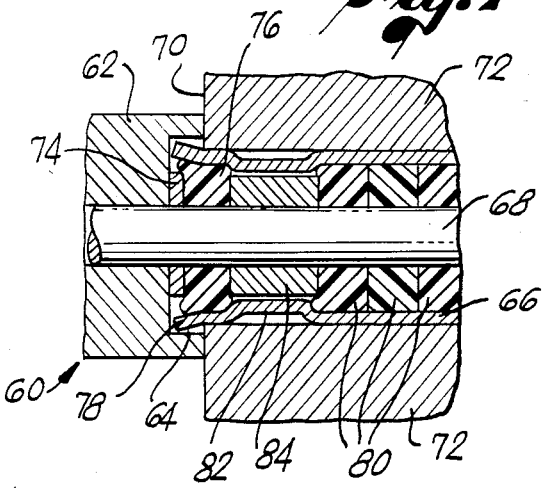

METHOD FOR INSTALLING TUBES IN TUBE SHEETS

RELATED APPLICATIONS

This is a divisional of application Ser. No. 271,372 entitled TUBULAR STRUCTURE EXPANSION METHOD AND APPARATUS filed on June 8, 1981 now abandoned, which is a continuation-in-part of application Ser. No. 255,789 entitled METHOD AND APPARATUS FOR RADIALLY EXPANDING TUBES, filed Apr. 20, 1981 now U.S. Pat. No. 4,387,507, issued June 14, 1983.

FIELD OF THE INVENTION

The present invention relates to a method for expanding tubes that is particularly suitable for installing tubes within a tube sheet.

BACKGROUND OF THE INVENTION

It is often necessary to expand a tube radially to form a leak-proof joint between the exterior of the tube and a surrounding tube sheet. Either roller swaging or hydraulic swaging can be used to produce tube expansion. Roller swaging employs a mechanical implement inserted in the tube and pressed against the tube surface, forcing the tube wall radially outwardly. The roller is repeatedly passed over the interior tube surface until the desired expansion has been produced.

Hydraulic swaging, which is generally superior, particularly for high pressure applications in small diameter tubes, employs a mandrel which is inserted in the tube to seal two ends of an elongated annular volume. Hydraulic fluid under pressure, which may be as high as 30,000 psi or more, is then introduced to the annular volume between the mandrel and the tube, forcing the tube to expand.

The use of swaging to expand tubes radially is of great importance in the construction of heat exchangers, particularly those heat exchangers intended for use in power plants. Hydraulic swaging, using pressures among the highest attainable, is found to be the most effective for this demanding application.

A problem that arises in this type of operation is that of anchoring the tube within the tube sheet in preparation for the high pressure swaging operation. One solution is to pre-expand a portion of the tube against the tube sheet prior to the insertion of the mandrel. It has been found, however, that the inner mandrel seal often engages an unexpanded portion of the tube while the outer mandrel seal engages the pre-expanded portion. When fluid pressure is supplied, the axial forces acting on the mandrel are unbalanced due to the unequal diameters of the tube at the location of the two seals, and consequently, the mandrel tends to move axially within the tube.

An objective of the present invention is to provide a new and improved method for expanding a tube radially. A further objective is to provide such a method that results in the generation of balanced axial forces in the mandrel.

SUMMARY OF THE INVENTION

The above objectives are accomplished by first inserting a tube into a bore in a tube sheet and then initially expanding a selected region of the tube while leaving unexpanded regions on both sides of the selected region. A swaging mandrel is then inserted in the tube, the mandrel having two axially separated seals that define a pressure zone between them. The mandrel is positioned so that the seals are located on opposite sides of the selected region. Pressurized fluid is supplied to an annular space between the mandrel and the tube expanding the tube throughout a pressure zone while the axial forces acting on the mandrel are balanced.

Preferably the initial expansion of the tube is accomplished by inserting a draw bar encircled by at least one expander and compressing the expander axially by pulling the draw bar. It is most advantageous to use two expanders corresponding to inner and outer regions of the tube to be expanded, leaving an unexpanded land between these regions. When the mandrel is inserted, both mandrel seals engage unexpanded portions of the tube, one of these portions being the land.

In one embodiment of the invention, a stop attached to the draw bar is positioned outside the tube sheet and an anti-extrusion ring slides on the draw bar between the outer expander and the stop as the tube is expanded.

BRIEF DESCRIPTION OF THE DRAWINGS

FIG. 3 is a transverse cross-sectional view of the tube, tube sheet and draw bar apparatus after pre-expansion of the tube has taken place;

FIGS. 4 and 5 are cross-sectional views showing a hydraulic mandrel properly positioned in the tube before and after hydraulic swaging; and FIGS. 6 and 7 are fragmentary cross-sectional views, on a larger scale, showing the outer end of a second draw bar apparatus also useful in practicing the method of the invention.

DESCRIPTION OF THE PREFERRED EMBODIMENTS

Figure 1:
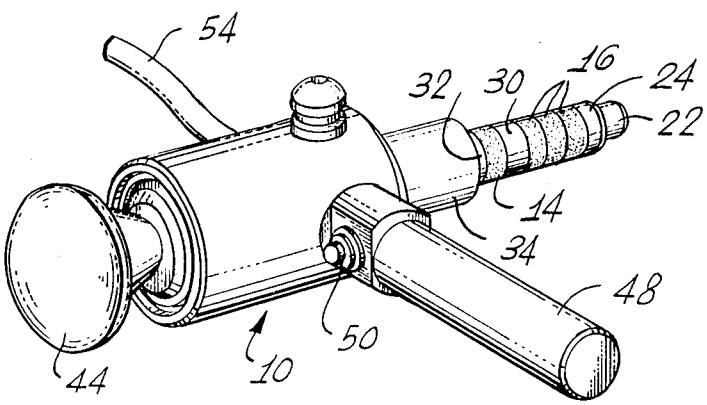
FIG. 1 is a perspective view of a draw bar apparatus used in practicing the method of the invention.
Figure 2:
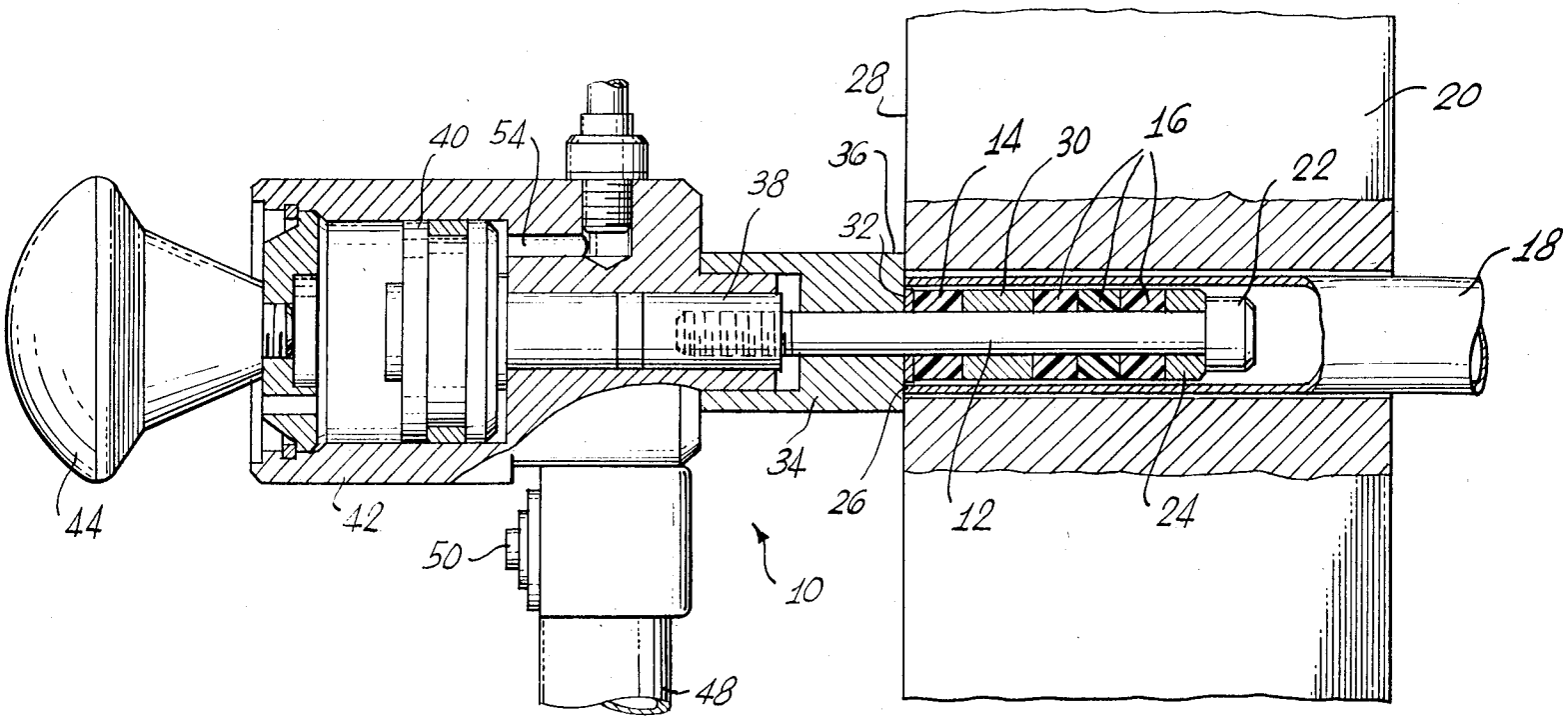
FIG. 2 is a side elevation, mostly in cross section, showing the draw bar apparatus inserted in a tube within a tube sheet, the small annular space between the tube and the sheet being somewhat exaggerated for purposes of illustration.

An apparatus 10, useful in carrying out the method of the present invention and shown in FIGS. 1 through 5 of the accompanying drawings, includes a draw bar 12 encircled by a single outer expander 14 and a segmented inner expander 16. The draw bar 12 and the expanders 14 and 16 are inserted axially in a tube 18 positioned within a bore of a tube sheet 20, in accordance with FIGS. 2–5.

The draw bar 12 is an elongated member of lesser diameter than the interior of the tube 18. It carries a head 22 at the end inserted in tube 18 first, the inner expander 16 being spaced from the head by an incompressible steel washer 24. Near the opposite end of the draw bar 12, the outer expander 14 is positioned adjacent to one end 26 of the tube 18 where the tube terminates at the primary or working face 28 of the tube sheet 20. The outer expander 14 is separated from the inner expander 16 by an annular steel spacer 30. On the opposite side of the outer expander from the spacer 30 is a steel anti-extrusion ring 32 which, like the expander 14 and 16 and the spacer 30, is slidable on the draw bar 12. The outer and inner secondary expanders 14 and 16 are of the same outer and inner diameter, slightly less than the inside diameter of the tube 18.

On the primary side 28 of the tube sheet 20, the draw bar 12 is received by an opening in the center of an anvil 34. As a face 36 of the anvil 34 rests against the primary surface of the tube sheet, the anvil serves as a stop to position the apparatus 10 with respect to the tube 18 and tube sheet 30.

The end of the draw bar 12 opposite the head 22 is anchored to an extension 38 of a piston 40, the piston being reciprocable within a hydraulic cylinder 42 (see FIG. 2) that extends from the anvil 34. At the end of the hydraulic cylinder 42 farthest from the tube sheet 20 is a knob-shaped handle 44 by which the apparatus 10 can be manipulated and held against the tube sheet 20. A cylindrical rod-shaped handle 48 extends from the side of the anvil perpendicular to the draw bar 12 (see FIG. 1). Mounted on the rod-shaped handle 48 is an electrical switch 50 that controls the flow of hydraulic fluid, the switch being connected to a pressurized fluide source (not shown).

The draw bar 12 and expanders 14 and 16 are positioned within the tube 18, as explained above, and the draw bar is then actuated by admitting hydraulic fluid to the cylinder 42 through a passage 54 (FIG. 2), thus forcing the piston 40 to move away from the tube sheet 20. As the piston 40 moves, it pulls the draw bar 12 with it, and the head 22 of the draw bar, moving toward the anvil 34, exerts an axial compressive force on the outer expander 14 and the inner expander 16.

The expanders 14 and 16 are made of polyurethane, a material which has the properties of a solid under normal conditions but behaves as a hydraulic fluid under high pressure. Nevertheless, the polyurethane expanders 14 and 16 have a memory and will return to their original shapes after the force of the draw bar 12 is removed.

The inner expander 16, which is longer when measured axially, is formed of separate ring-shaped segments to provide an optimum relationship between the transverse cross-sectional area and the axial length. If these segments are not properly proportioned, axial compressive forces will not be transformed into radial expansive forces with maximum effectiveness. For example, if the segments have an external diameter of five-eighths inch and an internal diameter of three-eighths inch, an axial length of one-third inch is advantageous.

Two functions are performed by the expanders 14 and 16. Firstly, they grip the inside of the tube 18 and pull the tube toward the anvil 34 as the bolt 12 is moved by the piston 40, thereby precisely locating the tube within the tube sheet 20. Secondly, the expanders 14 and 16 cause the corresponding regions of the tube 18 to bulge (see FIG. 3), thus helping to anchor the tube 18 within the tube sheet 20. The region corresponding to the spacer 30 is not expanded and forms a land 56. The radial transition zone 58 from the land 56 to the expanded region of the inner expander 16 enables the inner expander to grip the tube and pull it against the anvil 34. The outer expander 14 seals the outer end of the tube 18 tightly against the interior of the tube sheet bore, an important factor in eliminating or reducing corrosion and thereby extending the life of the tube and tube sheet 20, since this is an area of the tube where subsequent hydraulic swaging may be less effective.

When the draw bar 12 is actuated by the piston 40, the anti-extrusion ring 32 is positioned within the tube 18. As long as the ring 32 does not move fully out of the tube 18, the outer expander 14 cannot escape from the tube by extrusion except for the very small clearance between the ring and the tube. If the ring 32 were omitted, however, the outer expander 14 could be extruded between the anvil face 36 and the primary surface 28 of the tube sheet 20. It might then be difficult to manually hold the apparatus 10 in its full inserted position.

Once the pre-expansion of the tube 18 is completed, hydraulic fluid is permitted to flow out through the passage 54 by the operation of a valve (not shown) so that the piston 40 can move back toward the tube sheet 20. With the axial force on the expanders 14 and 16, they return to their original shape and the apparatus 10 can be readily withdrawn from the tube 18. The tube 18 is then firmly anchored in the tube sheet 20 and is ready for hydraulic swaging at pressures substantially higher than those which can be obtained in the manner described above.

A variation of this pre-expansion portion of the method and the apparatus 10 described above is best understood wtih reference to FIGS. 6 and 7. It employs a second apparatus 60 which is similar to the first apparatus 10 but utilizes an anvil 62 having a circular recess 64 of a diameter larger than that of a tube 66 with which it is to be used. The recess is concentric with a draw bar 68 that projects from the anvil 62.

The second apparatus 60 is intended for use with tubes, such as the exemplary tube 66, that project slightly beyond the primary surface 70 of a tube sheet 72. Thus, an anti-extrusion ring 74 and an outer expander 76 are both located within the protruding portion of the tube 66 when the anvil 62 is pressed tightly against the tube sheet face 70. Upon pulling the draw bar 68, the outer expander 76 causes the protruding portion 78 of the tube 66 to flare outwardly, as shown in FIG. 7. This technique has the advantage of positvely preventing the tube 66 from moving into the bore of the tube sheet 72.

When the draw bar 68 is actuated, an inner expander 80 causes radial expansion of an internal section of the tube 66. The outer expander 76 causes an outer portion of the tube 66 within the tube sheet 72 to expand, in addition to causing flaring of the external portion of the tube. An unexpanded portion of the tube 66 forms a land 82 corresponding to a steel spacer 84 between the two expanders 76 and 80.

The draw bar apparatus 10 or 60 is used, as explained with reference to FIGS. 1–3, 6 and 7, only for pre-expansion purposes. It is generally desirable to further expand the tube by high hydraulic swaging forming a joint having the desired high reliability, corrosion resistant and leak proof qualities. The radial pressure produced by hydraulic swaging tends to be more uniform throughout this region in which it is applied and is often of a greater effective magnitude because it is not subject to the frictional forces that influence the operation of the draw bar apparatus 10 or 60.

The hydraulic swaging phase of the method will now be explained with reference to FIGS. 4 and 5, which show the exemplary tube 18 after pre-expansion, the tube end 26 being flush with the primary surface 28. A mandrel 90 is inserted in the tube 18 in the same manner as the draw bar 12, as shown in FIG. 4. The mandrel 90 includes two axially separated seals 92 and 94 that define a pressure zone between them. Each seal of the exemplary mandrel 90 includes an O-ring 96 on the high pressure side and a polyurethane back-up ring 98 on the low pressure side. The tube 18 cannot move axially under the insertion force of the mandrel as the seals 92 and 94 slide inwardly because it has been anchored by pre-expansion.

The mandrel 90 is positioned so that an external mandrel head 100 engages the primary surface 28 of the tube sheet 20. The outer seal 92 engages the land 56 of the tube 18, while the inner seal 94 is positioned beyond the portion of the tube affected by the inner expander 16, in this case the end of the inner seal being flush with the secondary face 108 of the tube sheet 20. Thus, both seals 92 and 96 engage unexpanded portions of the tube 18 that are of equal inner diameter. Pressurized hydraulic fluid, which may be oil or water, is then admitted through a passageway 102 to a small annular space 104 between the mandrel 90 and the interior surface of the tube 18. The pressure may be 30,000 psi or more and the wall of the tube 18 is pressed radially outwardly against the surrounding tube sheet 20. Elastic deformation of the tube 18 can be achieved throughout the pressure zone, including the area occupied by the seals 92 and 94 themselves, so that the tube sheet 20 clamps the tube 18 tightly when the pressure is removed. The extreme outer end of the tube 18 which is not affected by hydraulic swaging has been expanded by the draw bar apparatus 12, eliminating the need to maintain close tolerance when positioning the outer seal 92 of the mandrel 90.

It should be noted that the swaging pressure does not cause the mandrel 90 to tend to move axially within the tube 18, nor can it cause movement of the tube within the tube sheet 20. In other words, the axial forces attributable to the swaging pressure are balanced due to the land 56 which permits the two seals 92 and 94 to engage tube portions of equal diameter. It is, therefore, easy for the operator to hold the mandrel 90 precisely in place manually during the entire operation.

While particular forms of the invention have been illustrated and described, it will be apparent that various modifications can be made without departing from the spirit and scope of the invention.

I claim:

1. A method of installing a tube within a surrounding structure to form a tight leakproof joint between said tube and said structure, said method comprising the steps of:

inserting said tube in a bore in said structure from a first side of said structure;

inserting a draw bar in said tube, said drawbar being encircled by compressible inner and outer expanders;

compressing said expanders axially and expanding said expanders radially, thereby initially expanding an outer region of said tube corresponding to said outer expander and adjacent said first side and an inner region of said tube corresponding to said inner expander axially spaced from said outer region, leaving an unexpanded land between said inner and outer regions;

removing said draw bar and said expanders from said tube;

inserting a hydraulic swaging mandrel in said tube, said mandrel having two axially separated seals defining a pressure zone between them;

positioning said mandrel so that said seals are located on opposite sides of said inner region within unexpanded portions of said tube, one of said unexpanded portions being said land; and supplying pressurized fluid to an annular space between said mandrel and said tube corresponding to said pressure zone and thereby further expanding said tube radially throughout said pressure zone, the axial forces acting on said mandrel and attributable to said fluid being balanced.

2. The method of claim 3 further comprising:

positioning a stop member attached to said draw bar outside said tube sheet to restrain said draw bar against axial movement; and causing an anti-extrusion ring to slide axially on said draw bar between said outer expander and said stop member as said regions of said tube are expanded.

3. The method of claim 1 wherein said surrounding structure is a tube sheet.

4. The method of claim 1 wherein said fluid is supplied at a pressure that exceeds the pressure applied to said tube during said initial expanding step.

5. A method of installing a tube within a surrounding structure to form a tight leak-proof joint between said tube and said structure, said method comprising the steps of:

inserting said tube in a bore in said structure;

inserting a draw bar within said tube, said draw bar being encircled by axially compressible outer and inner expanders axially separated by an incompressible spacer;

compressing said expanders axially and expanding said expanders radially by pulling said draw bar and thereby initially expanding said tube radially in the regions of said expanders while leaving said tube substantially unexpanded and thus forming a land in the region of said spacer;

removing said draw bar, said expanders and said spacer from said tube;

inserting a hydraulic swaging mandrel in said tube, said mandrel having two axially separated seals defining a pressure zone between them;

positioning said mandrel so that one of said seals engages said land, the other of said seals being positioned on the opposite side of the region that corresponds to said inner expander, said tube being unexpanded and of equal diameter at said two seals; and supplying pressurized fluid through said mandrel to an annular space between said mandrel and said tube corresponding to said pressure zone and thereby expanding said tube radially throughout said pressure zone, the axial forces acting on said mandrel and attributable to said fluid being balanced.

6. The method of claim 5 wherein:

said tube is positioned so that it projects out of said surrounding structure; and said region corresponding to said outer expander extends out of said tube sheet, whereby a portion of said tube that is outside said structure is flared radially outwardly by pulling said draw bar.

7. The method of claim 6 further comprising:

positioning a stop attached to said draw bar outside said structure to restrain said draw bar against axial movement toward said structure; and causing an anti-extrusion ring to slide axially on said draw bar, thereby inhibiting extrusion of said outer expander.

8. The method of claim 5 further comprising:

positioning a stop attached to said draw bar outside said structure to restrain said draw bar against axial movement toward said structure; and causing an anti-extrusion ring to slide axially on said draw bar, thereby inhibiting extrusion of said outer expander.

9. The method of claim 5 wherein said surrounding structure is a tube sheet.

10. The method of claim 5 wherein said fluid is supplied at a pressure that exceeds the pressure applied to said tube by said expanders.

11. A method of installing a tube within a tube sheet to form a leak-proof joint between said tube and said tube sheet, said method comprising the steps of:

inserting said tube in a bore in said tube sheet and positioning said tube so that it projects out of said tube sheet;

inserting a draw bar within said tube, said draw bar being encircled by axially compressible outer and inner expanders axially separated by an incompressible spacer, said draw bar further having an anti-extrusion ring thereon adjacent said outer expander;

positioning said draw bar so that a stop thereon contacts said tube sheet and restrains said draw bar against axial movement toward said tube sheet;

compressing said expanders axially and expanding said expanders radially by pulling said draw bar and thereby initially expanding said tube radially in the regions of said expanders while leaving said tube substantially unexpanded and thus forming a land in the region of said spacer, said region corresponding to said outer expander extending outside said tube causing a corresponding portion of said tube to be flared radially outwardly while said anti-extrusion ring slides axially on said draw bar, thereby inhibiting extrusion of said outer expander;

removing said draw bar, said expanders and said spacer from said tube;

inserting a swaging mandrel so that one of said seals engages said land, the other of said seals being positioned on the opposite side of the region that corresponds to said inner expander, said tube being unexpanded and of equal diameter at said two seals; and supplying fluid, at a pressure exceeding the pressure applied to said tube by said expanders, through said mandrel to an annular space between said mandrel and said tube corresponding to said pressure zone and thereby expanding said tube radially throughout said pressure zone, the axial forces acting on said mandrel and attributable to said fluid being balanced.

* * * * *